United States Patent [19]

Secrist

[11] Patent Number: 5,037,344

[45] Date of Patent: Aug. 6, 1991

[54] REALISTIC UNIVERSAL FITTING PLASTIC DOLL EYE

[76] Inventor: Pat R. Secrist, 2174 E. Ashby Rd., Midland, Mich. 48640

[21] Appl. No.: 544,700

[22] Filed: Jun. 27, 1990

[51] Int. Cl.[5] ..... A63H 3/38

[52] U.S. Cl. ..... 446/392

[58] Field of Search ..... 446/392, 343, 341, 342, 446/344, 350, 389; 623/4

[56] References Cited

U.S. PATENT DOCUMENTS

| | | | |
|---|---|---|---|
| 2,589,462 | 3/1952 | Wagner | 446/392 |
| 2,685,760 | 8/1952 | Wagner | 446/392 |
| 3,846,199 | 11/1974 | Cappelli | 623/4 |
| 4,233,776 | 11/1980 | Suzuki | 446/392 |
| 4,875,888 | 10/1989 | Harvey | 446/392 |

FOREIGN PATENT DOCUMENTS

| | | | |
|---|---|---|---|
| 631957 | 1/1962 | Italy | 446/392 |
| 642065 | 8/1950 | United Kingdom | 446/392 |
| 914172 | 12/1962 | United Kingdom | 446/392 |

*Primary Examiner*—Robert A. Hafer
*Assistant Examiner*—David J. Kenealy
*Attorney, Agent, or Firm*—Merlin B. Davey

[57] ABSTRACT

This invention provides an artificial doll eye with a realistic pupil opening allowing light to travel into the eye thrugh the lens some distance into a solid, transparent light shaft in the center of the lens and pupil giving the impression of a real human eye. An iris is simulated by a combination of a thin wafer having a colored surface, and an optical magnifying effect created by the texturing of the plastic in front of the colored wafer.

14 Claims, 1 Drawing Sheet

REALISTIC UNIVERSAL FITTING PLASTIC DOLL EYE

BACKGROUND OF THE INVENTION

The present invention relates to artificial eyes and, more particularly, to a plastic artificial doll eye.

In certain types of dolls, for example, dolls that are purchased by doll collectors, it is highly desirable for the doll eye to have the appearance of a human eye. As the dolls become more realistic in their appearance their value goes up.

Hitherto, doll eyes having the most realistic appearance have been produced by blown glass. Such doll eyes are expensive and sometimes hard to obtain.

Murch, in U.S. Pat. No. 4,393,619, proposed to solve this problem by providing a doll eye constructed of a thermal setting clay coating, e.g., porcelain.

SUMMARY OF THE INVENTION

The present invention provides an artificial eye with a realistic pupil opening allowing light to travel into the eye through the lens (cornea) some distance into a solid, transparent light shaft in the center of the lens and pupil giving an impression of a real human eye. An "iris" comprising two parts is simulated by (1) a relatively thin, wafer-like colored material, e.g., paper, a paper pulp product, metallic foil, plastics material or decal such as a thin plastics film having a colored surface and (2) by the configuring or texturing of the back (inner) side of the cornea with the light shaft in the center. The "iris" can be textured or configured to resemble the physical relief features of a real human eye and serves to augment the impression of realism.

DETAILED DESCRIPTION OF THE INVENTION

The invention will be further understood by reference to the accompanying drawings wherein.

Figure 1:
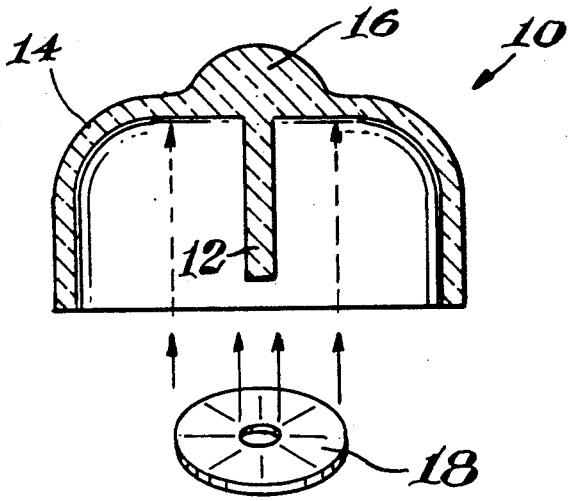
FIG. 1 represents a cross-section of a doll eye made of a clear plastics material.

In FIG. 1, artificial eye (10) is seen to have a clear shaft-like column (12) which is an integral part of the main body (14) of the eye molded of a clear plastics material. The column (12) permits light to travel down through it, much in the same manner as light travels through a fiber optic strand. When viewing the eye from its front side, this transparent column gives the impression of a real pupil with depth to it. In FIG. 1, the area immediately surrounding the column (12) on the inner side of the corneal portion (16) may be contoured to simulate the ripples or radial lines in the iris of the human eye. A flat doughnut shaped wafer made of, e.g., paper, a paper pulp product, metallic foil, plastics material or a decal (18), with the center punched out of it, is slid over the column (12) and up against the surface around the light shaft on the inner side of the corneal portion (16). This iris shaped wafer is colored on one side to look the color of a real human eye. The wafer (18) may or may not be contoured or configured.

When looking at the eye from its front (outer) side the contoured surface around the light shaft magnifies the colored wafer. The uneven magnification caused by the ripples gives the impression of a real iris.

Figure 2:
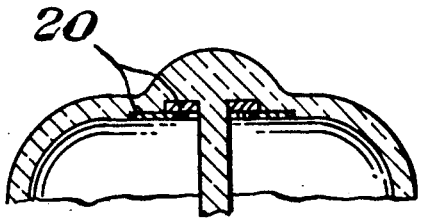
FIG. 2 is a cross-section of another embodiment of a doll eye of this invention.

In FIG. 2 it is seen that the surface around the light shaft can be in the form of one or more elevations (20) ascending or descending adjacent to and surrounding at least a portion of the light shaft (12). Such elevations need not be continuous or uniform and need not be in the stepped or terraced form shown. Each step or elevation of the surface can be successively larger or smaller than the previous step and need not be concentric therewith, thus adding depth to the eye. Alternative configurations include, for example, curved convex and/or concave configurations which serve to act as magnifying lenses similar to, for example, fresnel lenses. Magnification may also be achieved by angular shapes, configurations or grooves radiating from the pupil in the transparent material if desired.

Figure 3:
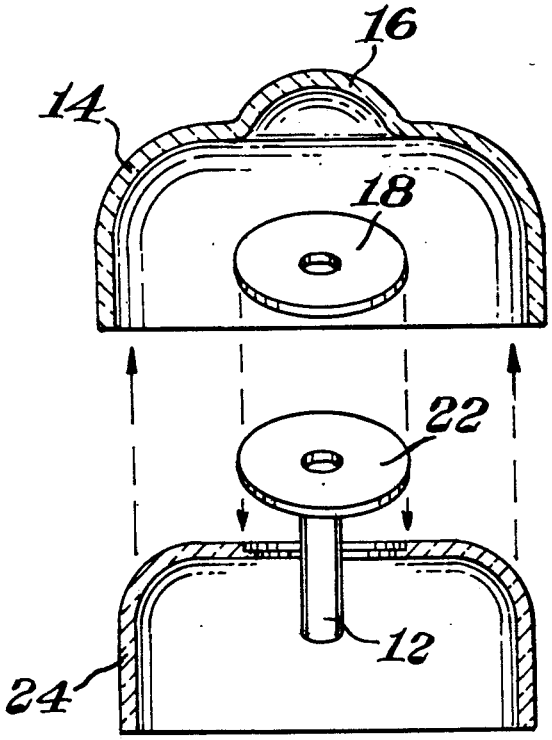
FIG. 3 is a cross-section exploded view of still another embodiment of the doll eye of this invention.

As shown in FIG. 3, the column (12) and a disc (22) could be molded separately from the corneal portion, as one unit, which would from its profile, look like a mushroom or a "T". Disc (22) can be configured to give the impression of an iris as described above, or it can have a flat surface and a washer shaped wafer (18) can be applied to simulate the iris. Wafer (18) may or may not be textured or configured as desired. In this embodiment, the transparent mushroom-shaped piece (12) and (22), including, if desired, wafer (18) could be fitted into a white opaque molded portion (24) that would fit snuggly into the transparent eye cover (14). Opaque portion (24) serves to simulate the sclera of a real eye. The desired opaqueness can be achieved by appropriately coloring a substantially transparent material or by employing an opaque material.

Alternatively, light shaft (12) could be formed as part of the sclera (24). In this embodiment, if the sclera is made of a substantially transparent material, it can be colored on the inside surface to provide the desired opaqueness. In this embodiment the washer shaped wafer (18) simulated iris can be positioned between the sclera insert and the eye cover (14) by means known in the art.

In a still further embodiment, the wafer (18) could be applied directly to the inner side of the cover (14) behind the cornea and a sclera fitted into the cover, surrounding and possibly covering a portion of the wafer without covering the pupil. Then a substantially transparent filling material could be applied inside the sclera with sufficient depth to form a light path with the pupil thereby giving depth to the eye.

The doll eye of this invention will fit in virtually all vinyl and thermal setting collectible dolls with inserted moving and nonmoving eyes and is readily and inexpensively prepared from substantially transparent plastics materials such as, for example, various acrylic and other thermal and non-thermal setting resins available on the market.

Various modifications may be made in the present invention without departing from the spirit or scope thereof.

I claim:

1. An artificial doll eye comprising a generally eye-shaped, substantially transparent first molded plastics material cover, said cover including a corneal portion having an outer side and an inner side, said corneal portion being positioned substantially in the center of the outer side of said cover, said eye including a generally flat circular washer-shaped wafer having a hole therein simulating the pupil of said eye positioned adjacent said inner side of said corneal portion, said eye further including a substantially transparent plastics material in the form of a column extending through said hole in said wafer and toward the interior of said eye.

2. Artificial eye of claim 1 wherein at least the outward facing side of said wafer is colored.

3. Artificial eye of claim 1 wherein the transparent plastics column and said wafer are molded separately from the eye cover.

4. Artificial eye of claim 1 wherein said wafer is made of paper or a paper pulp product.

5. Artificial eye of claim 1 wherein said wafer is made of a plastics material.

6. Artificial eye of claim 1 wherein said wafer is an opaque decal.

7. Artificial eye of claim 1 wherein the surface on the inner side of the corneal portion and around the pupil is grooved.

8. Artificial eye of claim 7 wherein the surface is contoured in the form of one or more elevations thereby giving the impression of added depth to the eye.

9. Artificial eye of claim 8 wherein the elevations are in the form of a stepped terrace.

10. Artificial eye of claim 7 wherein the inner side of the corneal portion is configured in a manner such that the wafer appears magnified.

11. Artificial eye of claim 10 wherein the contoured surface comprises at least one convex and/or concave configuration.

12. Artificial eye of claim 1 wherein the eye comprises a simulated sclera and the transparent column and sclera are molded together as one piece.

13. Artificial eye of claim 10 wherein the inner side of the corneal portion comprises at least one concave configuration.

14. Artificial eye of claim 1 wherein the surface on the inner side of the corneal portion and around the pupil is colored.

* * * * *